US005707256A

United States Patent [19]

Tsuchiya et al.

[11] Patent Number: 5,707,256

[45] Date of Patent: Jan. 13, 1998

[54] CONNECTOR FOR AN ELECTRIC VEHICLE

[75] Inventors: Shinichi Tsuchiya; Mitsuhiro Matsumoto; Hidehiko Kuboshima, all of Shizuoka, Japan

[73] Assignee: Yazaki Corporation, Tokyo, Japan

[21] Appl. No.: 587,756

[22] Filed: Jan. 17, 1996

[30] Foreign Application Priority Data

Jan. 18, 1995 [JP] Japan ..... 7-005938

[51] Int. Cl.[6] ..... H01R 13/40

[52] U.S. Cl. ..... 439/752.5; 439/692

[58] Field of Search ..... 439/752.5, 681, 439/801, 682, 692

[56] References Cited

U.S. PATENT DOCUMENTS 4,904,194 2/1990 Kilsdonk et al. ..... 439/681

5,096,443 3/1992 Myrick et al. ..... 439/681

*Primary Examiner*—Gary F. Paumen

*Attorney, Agent, or Firm*—Sughrue, Mion, Zinn, Macpeak & Seas, PLLC

[57] ABSTRACT

A connector for an electric vehicle in which a bus bar connecting portion of a terminal is secured and connected, in parallel, to a plate-like bus bar arranged in either a vertical or horizontal orientation. In the connector, a connector housing has a terminal accommodating chamber in the form of a substantially cylindrical space, and a rotation-preventing face is provided on the inner wall of the terminal accommodating chamber to radially and inwardly protrude from the inner wall. A body portion of the terminal is formed into a rod to be fitted into the terminal accommodating chamber. The bus bar connecting portion in the form of a plate, with a width equal to an outer diameter of the body portion, is extended from the rear end of the body portion. Two slants are formed on the body portion by partially removing the body portion along two planes intersecting perpendicularly to each other. The slants selectively abut against the rotation-preventing face when the terminal is inserted into the terminal accommodating chamber.

3 Claims, 7 Drawing Sheets

CONNECTOR FOR AN ELECTRIC VEHICLE

BACKGROUND OF THE INVENTION

1. Field of the Invention

The invention relates to a connector for an electric vehicle in which a terminal is connected directly to a bus bar of a device mounted on the electric vehicle and, in particular, to a connector which can be used commonly to bus bars arranged in the different orientations.

2. Description of the Related Art

In connectors for an electric vehicle (hereinafter, referred to as "connectors"), there is one of a type which has a terminal adapted to be directly connected to a bus bar of a device. Hereinafter, an example of the connector of this type, in which the terminal has ribs to prevent the rotation of the terminal, will be described with reference to FIGS. 14 to 16B. FIG. 14 is a perspective view of a conventional terminal to be fitted into a connector. FIG. 15 is a longitudinal sectional view of the connector with the terminal fitted thereto. FIGS. 16A and 16B are rear views of two connectors which have different terminal regulating orientations from each other.

As shown in FIG. 14, for example, a female terminal 1 includes a cylindrical electric contact portion 3 at the end thereof, and a plate-like bus bar connecting portion 5 extended backward from the electric contact portion 3. The bus bar connecting portion 5 has a width A larger than an outer diameter B of the electric contact portion 3 to provide ribs 7 which project radially beyond the surface of the electric contact portion 3.

On the other hand, as shown in FIG. 15, a connector housing 9 has a terminal accommodating chamber 11 for accommodating the terminal 1 therein. The terminal accommodating chamber 11 opens at the rear end of the connector housing 9 to provide a terminal inserting port 13.

The bus bar connecting portion 5 of the terminal 1 is secured, in parallel, to a plate-like bus bar (not shown) by a bolt and a nut (not shown). However, the bus bar is held in either a vertical or horizontal orientation, that is, at an angular position of every 90 degrees about the axis in the terminal inserting direction, according to the specifications of the device and the like.

Thus, conventionally, two types of connector housings **9*a* and 9*b* are prepared as shown in FIGS. 16A and 16B. In FIG. 16A, one connector housing 9*a* includes a rectangular-hole-like cut 15 into which the ribs 7 are fitted, the cut 15 being formed horizontally in the terminal inserting port 13. In FIG. 16B, the other connector housing 9*b* includes a rectangular-hole-like cut 15 formed vertically in the terminal inserting port 13. That is, the connector housing 9*a* or 9*b*** corresponding to the orientation of the bus bar is selectively used in accomplishing the connection to the bus bars different from each other in orientation.

However, preparing the two types of connector housings **9*a* and 9*b***, for use with bus bars arranged in different orientations, increases the number of types of the connector housings to increase the production cost, such as a cost for die assemblies, and makes the parts control complicated. Additionally, in case of a multipole connector, this problem becomes more remarkable if the orientations of the respective terminals are different from each other.

Further, in the conventional connector, since the ribs 7, for holding the terminal 1 in an orientation, has a radial dimension larger than that of the electric contact portion 3, the terminal 1 must be machined by cutting a conductive metal material, such as a rod of copper which has a diameter equal to the width A of the ribs 7, to provide the outer diameter B on the electric contact portion 3. This increases the production cost since the number of machining processes increases and the ratio of the portion of the end product to the material, that is, the yield decreases.

Furthermore, in the conventional connector, if the terminal 1 is erroneously inserted, the connector housing 9 is sometimes damaged when the connector 1 is disconnected, leading to an interchange of the connector housing 9.

SUMMARY OF THE INVENTION

The invention was made in view of the above-mentioned problems, and has an object to provide a connector which can be used commonly to bus bars arranged in the different orientations, and allows a terminal to be produced at a low cost, thereby to decrease the number of types of the connectors which correspond to the orientations of the bus bars and the production cost.

To achieve the above-mentioned object, a first aspect of the invention provides a connector for an electric vehicle in which a plate-like bus bar connecting portion, which is formed on a terminal, is connected in parallel to a plate-like bus bar arranged in either a vertical or horizontal orientation, the connector comprising: a connector housing; and a terminal to be mounted into the connector housing, wherein the connector housing includes: a terminal accommodating chamber shaped like a substantially cylindrical space; and a rotation-preventing face formed so that the rotation-preventing face is protruded radially and inwardly on an inner wall of the terminal accommodating chamber, and wherein the terminal includes: a body portion shaped like a rod to be fitted into the terminal accommodating chamber; a plate-like bus bar connecting portion extending from a rear end of the body portion and having a width equal to an outer diameter of the body portion; and two slants formed by cutting the body portion in a diameter direction to intersect perpendicularly to each other, one of the slants selectively abutting against the rotation-preventing face when the terminal is inserted into the terminal accommodating chamber.

Further, a second aspect of the invention provides a connector for an electric vehicle in which a plate-like bus bar connecting portion, which is formed on a terminal, is connected in parallel to a plate-like bus bar arranged in either a vertical or horizontal orientation, the connector comprising: a connector housing; a terminal to be mounted into the connector housing; and a rear holder to be attached to the connector housing integrally with the terminal, wherein the connector housing includes: a terminal accommodating chamber shaped like a substantially cylindrical space, wherein the terminal includes: a body portion shaped like a rod to be fitted into the terminal accommodating chamber; and a plate-like bus bar connecting portion extending from a rear end of the body portion and having a width equal to a outer diameter of the body portion so that the plate-like bus bar connecting portion is projected from a terminal inserting port of the terminal accommodating chamber when the terminal is mounted into the terminal accommodating chamber, and wherein the rear holder includes: a rectangular hole through which the bus bar connecting portion passes, the rear holder is attached to the terminal inserting port of the terminal accommodating chamber of the connector housing at an arbitrary angular position of every 90 degrees about an axis thereof in a terminal inserting direction.

DETAILED DESCRIPTION OF THE PREFERRED EMBODIMENTS

Hereinafter, a preferred embodiment of a connector according to the invention will be described in detail with reference to the attached drawings.

Figure 1:
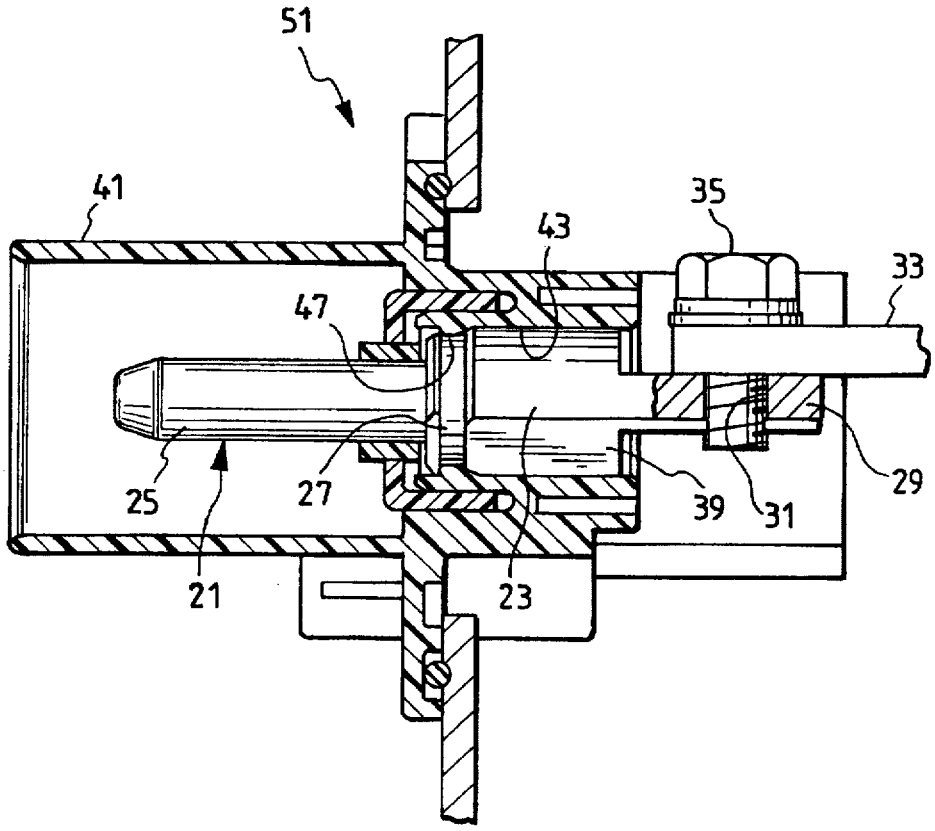
FIG. 1 is a longitudinal sectional view of a connector according to the invention with a terminal mounted thereto.
Figure 2:
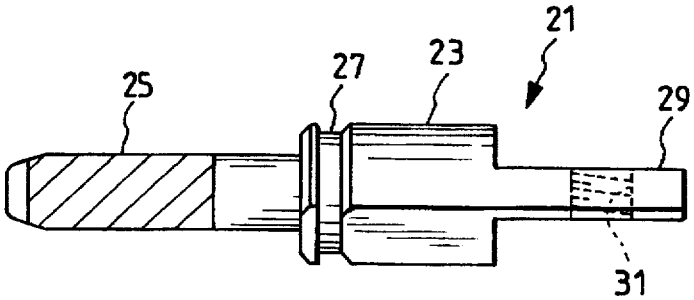
FIG. 2 is a side view of the terminal used for the connector according to the invention.
Figure 3:
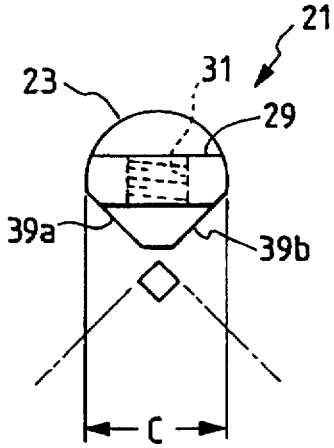
FIG. 3 is a rear view of the terminal shown in FIG. 2.
Figure 4:
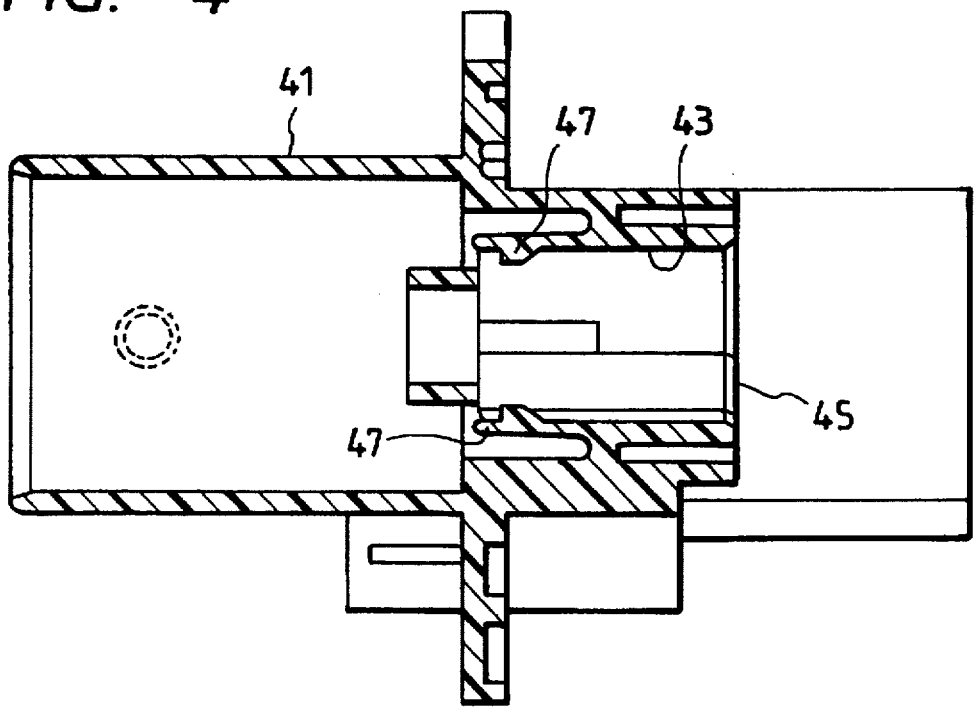
FIG. 4 is a longitudinal sectional view of a connector housing used for the connector according to the invention.
Figure 5:
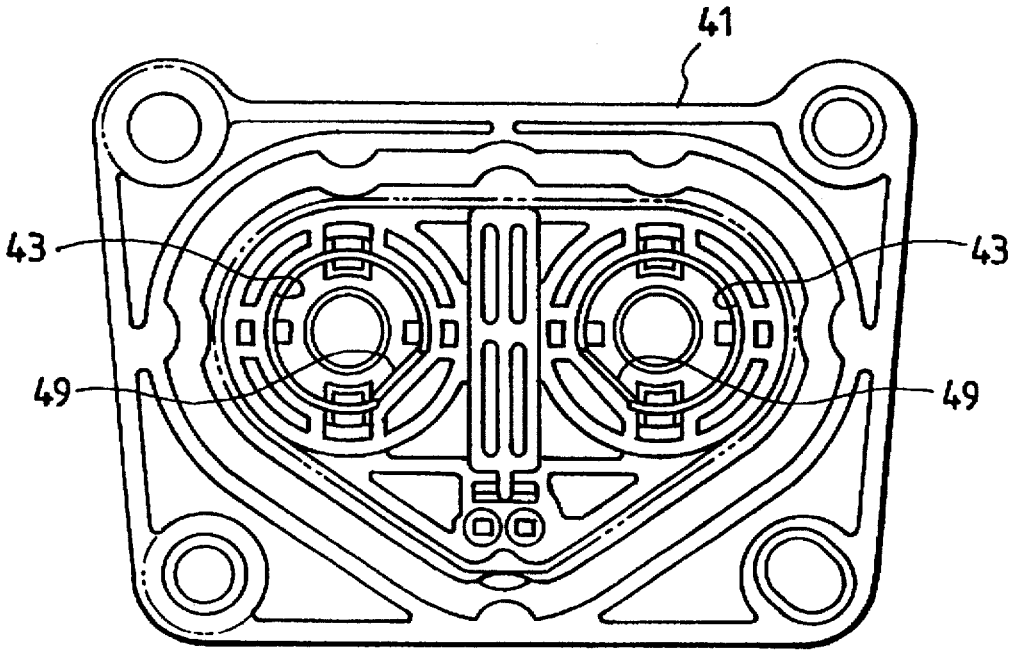
FIG. 5 is a rear view of the connector housing shown in FIG. 4.

FIG. 1 is a longitudinal sectional view of the connector according to the invention. FIG. 2 is a side view of a terminal used for the connector of the invention. FIG. 3 is a rear view of the terminal shown in FIG. 2. FIG. 4 is a longitudinal sectional view of a connector housing used for the connector of the invention. FIG. 5 is a rear view of the connector housing shown in FIG. 4.

A terminal 21 has a body portion 23 shaped like a rod, as shown in FIG. 2, and an electric contact portion 25 of a male type is projected at one end of the body portion 23. A peripheral groove 27 is formed along the outer surface of the body portion 23 for engagement with a locking claw provided within a connector housing which will be described later. A plate-like bus bar connecting portion 29 is extended outwardly from the other end of the body portion 23. The bus bar connecting portion 29 has a width equal to an outer diameter C of the body portion 23 (FIG. 3). Therefore, the terminal 21 may be machined by cutting a conductive metal material such as a rod of copper which has an outer diameter equal to the outer diameter C of the body portion 23. The bus bar connecting portion 29 includes a securing hole 31 through which a bolt 35 is inserted to secure and connect the bus bar connecting portion 29 to a plate-like bus bar 33 as shown in FIG. 1. As shown in FIG. 3, the body portion 23 includes two slants a and 39*b* perpendicular to each other, which are formed by partially cutting the body portion 23 in the diameter direction. The slants 39*a* and 39*b* are arranged to selectively abut against a rotation-preventing face provided in the connector housing which will be described later. In this embodiment, for the relative positional relationship between the slants 39*a* and 39*b* and the bus bar connecting portion 29, the horizontal bus bar connecting portion 29 is arranged between the slants 39*a* and 39*b* (FIG. 3). However, the invention is not limited to this relative positional relationship.

On the other hand, as shown in FIG. 4, the connector housing 41, which is made of an insulating resin material, has terminal accommodating chambers 43 (in this embodiment, two terminal accommodating chambers for two poles) which are shaped like substantially cylindrical spaces for receiving the terminals 21. Each of the terminal accommodating chambers 43 opens at the rear end of the connector housing 41 to provide a terminal inserting port 45. Flexible locking claws 47 are provided within each of the terminal accommodating chambers 43 to prevent the terminal 21 from being disconnected by engaging the claws 47 with the peripheral groove 27 of the terminal 21. Each of the terminal accommodating chambers 43 has a rotation-preventing faces 49, which radially and inwardly protrudes on the inner wall as shown in FIG. 5. The rotation-preventing face 49 selectively abuts against one of the slants 39*a* and 39 of the terminals 21. That is, the abutment of the rotation-preventing face 49 against one of the slants 39*a* and 39*b* allows the terminal 21 to be inserted into the terminal accommodating chambers 43 with the bus bar connecting portion 29 held in a vertical or horizontal orientation which is obtained by rotating the bus bar connecting portion 29 by 90 degrees about the axis in the terminal inserting direction. The rotation-preventing faces 49 are symmetrically arranged within the respective terminal accommodating chambers 43 (FIG. 5).

Figure 6:
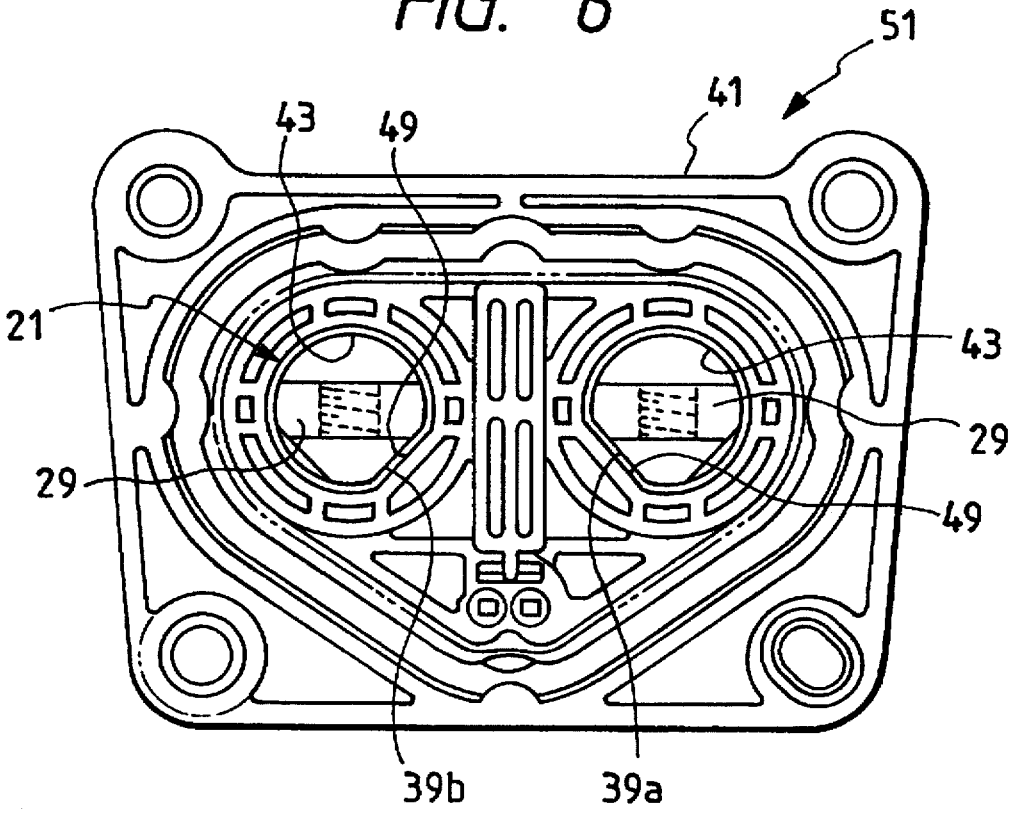
FIG. 6 is a rear view of the connector shown in FIG. 1.
Figure 7:
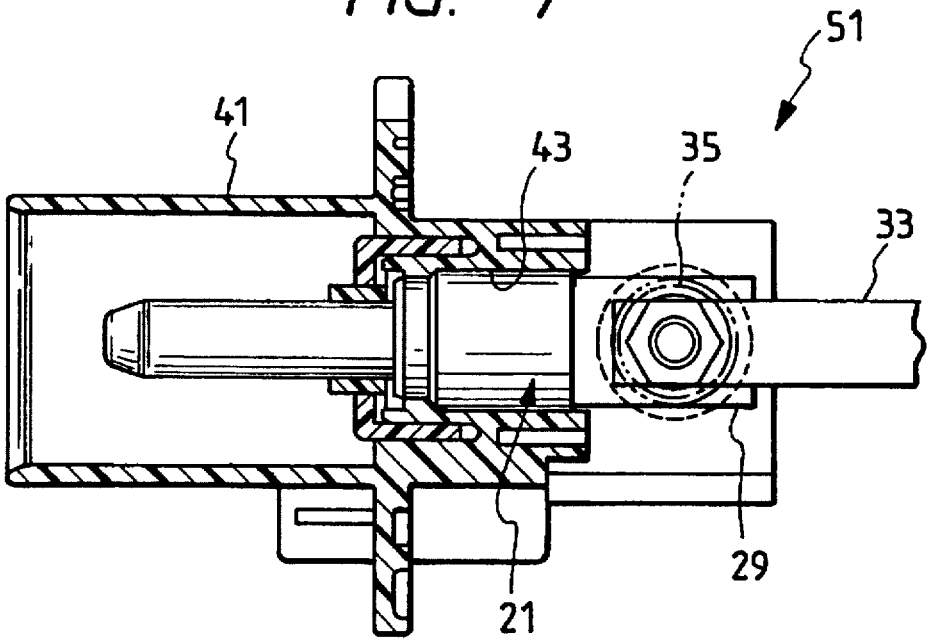
FIG. 7 is a longitudinal sectional view of the connector according to the invention with the terminal oriented vertically and mounted into the connector housing.
Figure 8:
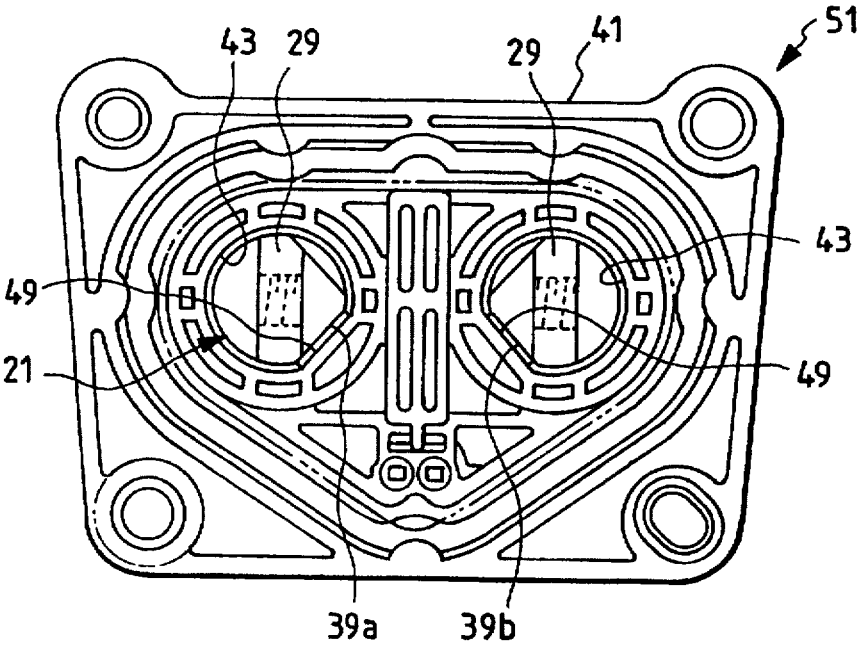
FIG. 8 is a rear view of the connector shown in FIG. 7.

The functional operation of a connector 51 which comprises the terminals 21 and the connector housing 41 thus formed. FIG. 6 is a rear view of the connector shown in FIG. 1. FIG. 7 is a longitudinal sectional view of the connector according to the invention, in which the terminal is oriented vertically and mounted into the connector housing. FIG. 8 is a rear view of the connector shown in FIG. 7.

Referring to the left side terminal accommodating chamber 43 in FIG. 6 as an example, when the terminal 21 is inserted into the terminal accommodating chamber 43 with the slant 39*b* abutting against the rotation-preventing face 49, the terminal 21 is prevented from rotating, and the bus bar connecting portion 29 is held in the horizontal orientation. This makes the bus bar connecting portion 29 parallel to the horizontal bus bar 33, which allows the bus bar connecting portion 29 to be secured and connected to the bus bar by the bolt 35, as shown in FIG. 1. In case of the right side terminal accommodating chamber 43, the slant 39*a* abuts against the rotation-preventing face 49 to hold the bus bar connecting portion 29 in the horizontal orientation.

Referring to the left side terminal accommodating chamber 43 in FIG. 8 as an example, when the terminal 21 is inserted into the terminal accommodating chamber 43 with the slant 39*a* abutting against the rotation-preventing face 49, the terminal is prevented from rotating and the bus bar connecting portion 29 is held in the vertical orientation. This makes the bus bar connecting portion 29 parallel to the vertical bus bar 33, which allows the bus bar connecting portion 29 to be secured and connected to the bus bar by the bolt 35, as shown in FIG. 7. In case of the right side terminal accommodating chamber 43, the slant 39*b* abuts against the rotation-preventing face 49 to hold the bus bar connecting portion 29 in the vertical orientation.

As described above, in the connector 51, one of the slants 39*a* and 39*b* of the terminal 21 selectively abuts against the rotation-preventing face 49, holding the bus bar connecting portion 29 in either the vertical or horizontal orientation. This allows the connector 51 to be adapted to the vertical and horizontal bus bars 33.

The abutment of one of the slants 39*a* and 39*b* against the rotation-preventing face 49 prevents the rotation of the terminal 21 within the terminal accommodating chamber 43, to facilitate the connection of the terminal 21 to the bus bar 33.

Figure 14:
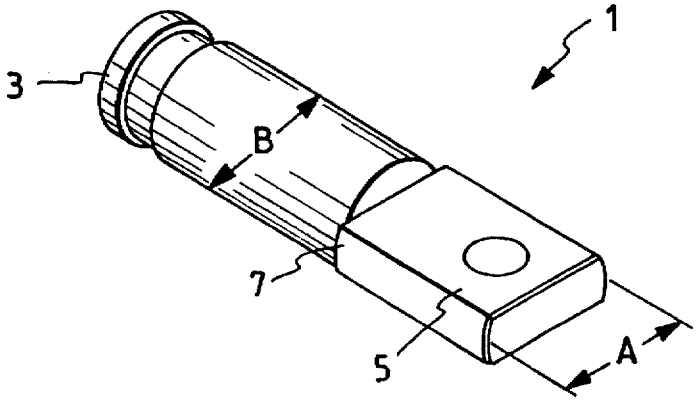
FIG. 14 PRIOR ART
FIG. 14 is a perspective view of a conventional terminal to be mounted to a connector.
Figure 15:
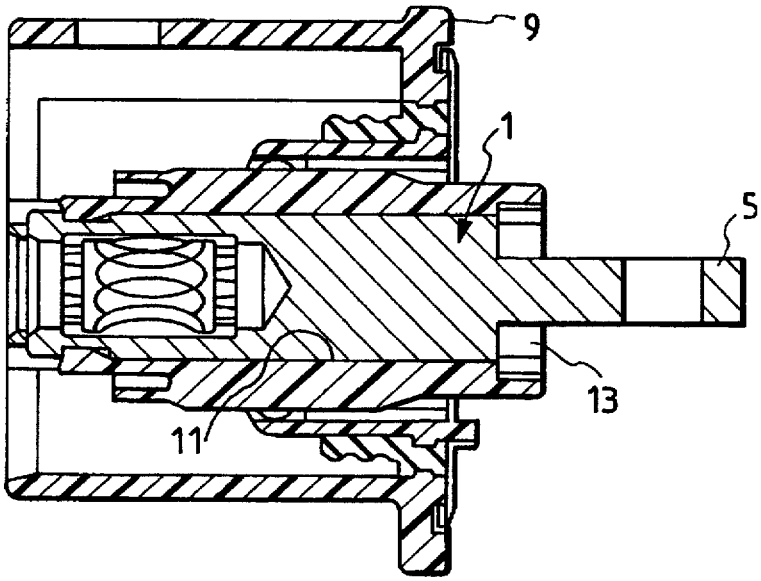
FIG. 15 PRIOR ART
FIG. 15 is a longitudinal sectional view of the connector with the terminal mounted thereto.
Figure 16A:
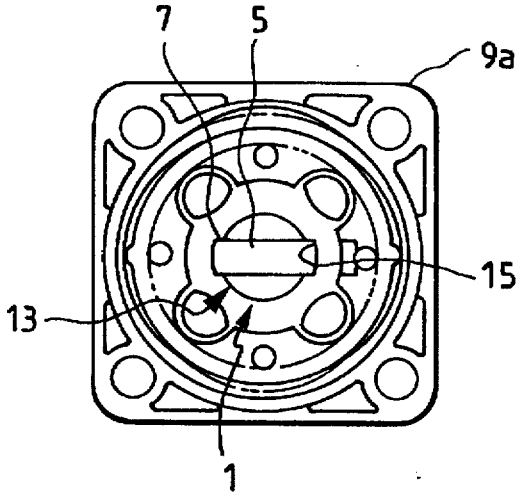
FIG. 16A PRIOR ART
FIG. 16A is a rear view of a connector in which a bus bar connecting portion is horizontally regulated.
Figure 16B:
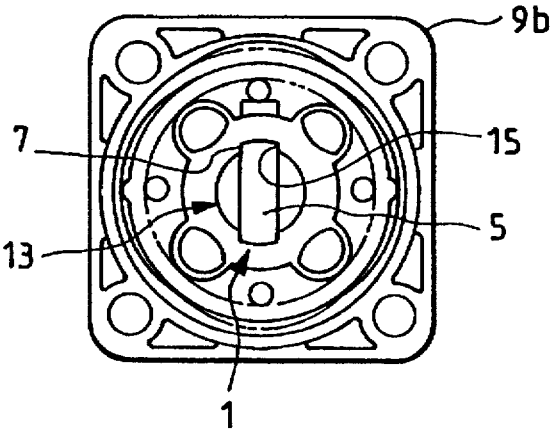
FIG. 16B PRIOR ART
FIG. 16B is a rear view of a connector in which the bus bar connecting portion is vertically regulated.

Further, the ribs 7 (refer to FIG. 14), which project from the electric contact portion 25, are no longer required. Thus, the cost of material and machining can be greatly reduced since a material, of an outer diameter equal to that of the terminal 21, can be used instead of a material of a larger outer diameter which is required to be cut.

Another embodiment of the invention will be described hereinafter.

Figure 9:
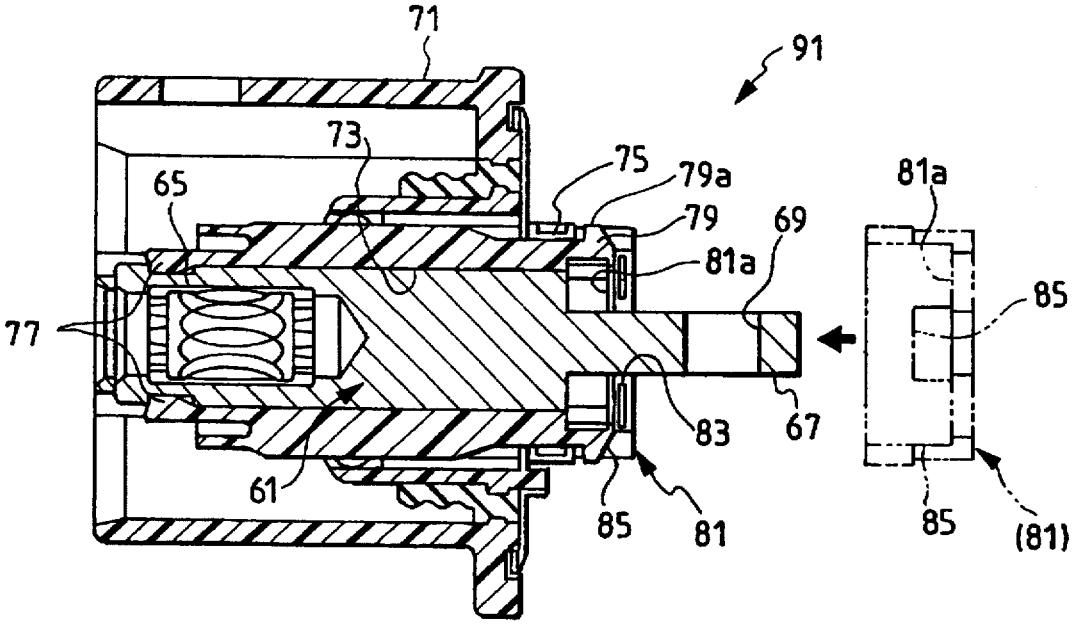
FIG. 9 is a longitudinal sectional view of a connector according to a second embodiment.
Figure 10:
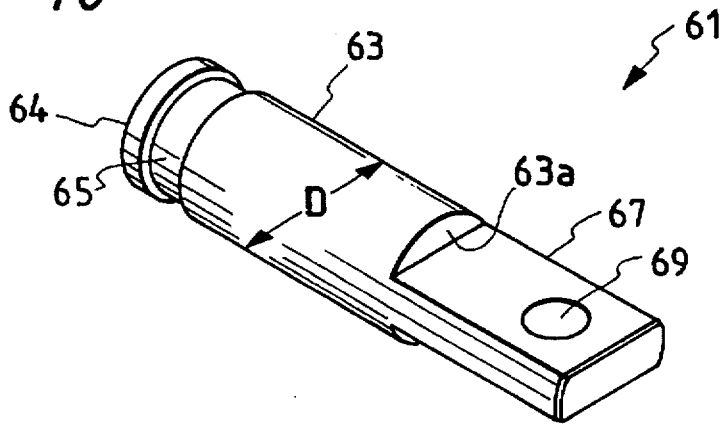
FIG. 10 is a perspective view of a terminal used in the second embodiment.
Figure 11:
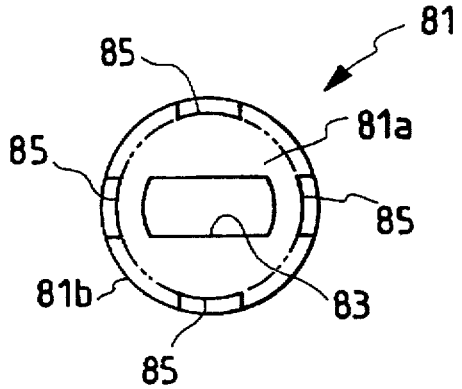
FIG. 11 is a rear view of a rear holder used in the second embodiment.

FIG. 9 is a longitudinal sectional view of the connector according to this embodiment. FIG. 10 is a perspective view of a terminal in this embodiment. FIG. 11 is a rear view of a rear holder used for this embodiment.

A terminal 61 has a body portion 63 shaped like a rod, as shown in FIG. 10, from one end of which an electric contact portion 64 of a female type with a hollow end extends outwardly. The body portion 63 has a maximum diameter of the terminal 61. A peripheral groove 65 is formed along the outer surface of the body portion 63 for engagement with a locking claw provided within a connector housing which will be described later. A plate-like bus bar connecting portion 67 is extended outwardly from the outer end of the body portion 63. The bus bar connecting portion 67 has a width equal to an outer diameter D of the body portion 63. Therefore, the terminal 61 may be machined by cutting a conductive metal material such as a rod of copper which has an outer diameter equal to the outer diameter D of the body portion 63. The bus bar connecting portion 67 includes a securing hole 69 through which a bolt 35 is inserted to secure and connect the bus bar connecting portion 67 to a plate-like bus bar 33 (FIG. 1).

Figure 13A:
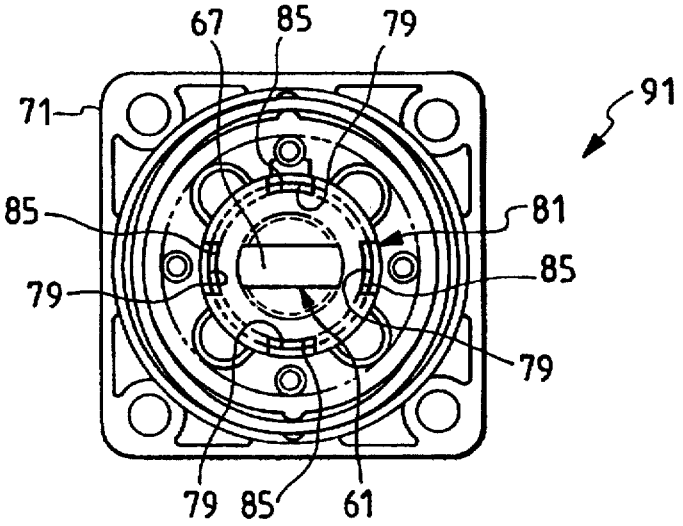
FIG. 13A is a rear view of the connector housing with the rear holder attached thereto, in which a bus bar connecting portion is horizontally provided.

On the other hand, as shown in FIG. 9, the connector housing 71, which is made of an insulating resin material, has a terminal accommodating chamber 73 which is shaped like a cylindrical space for receiving the terminal 61. The terminal accommodating chamber 73 opens at the rear end of the connector housing 71 to provide a terminal inserting port 75. Flexible locking claws 77 are provided within the terminal accommodating chamber 73 to prevent the terminal 61 from being disconnected by engaging the claws 77 with the peripheral groove 65 of the terminal 61. The cylindrical terminal inserting port 75 has four holder locking claws 79 crosswise, that is, with an interval of every 90 degrees about the axis (FIG. 13A). The holder locking claws 79 include claw portions 79*a* which project from the outer surface of the terminal inserting port 75. Further, the holder locking claws 97 are flexible, and the claw portions 79*a* can be elastically flexed inwardly at the terminal inserting port 75.

A rear holder 81 which is a cylindrical cap, shown in FIG. 11, is attached to the terminal 61 mounted to the connector housing 71. The rear holder 81 includes an end plate 81*a* at the opposite end to the cap opening thereof. The end plate 81*a* includes a rectangular hole 83 through which the bus bar connecting portion 67 passes so as to be fitted therein. Thus, the terminal 61 cannot rotate relatively to the rear holder 81 after the bus bar connecting portion 67 has been inserted into the rectangular hole 83 and integrally connected to the rear holder 81. The rear holder 81 is attached to the terminal inserting port 75 of the connector housing 71. The rear holder 81 includes four cuts 85 on a peripheral wall 81*b* crosswise, that is, with an interval of every 90 degrees about the axis thereof for engagement with the holder locking claws 79 of the terminal inserting port 75. In other words, the rear holder 81 can be attached to the terminal inserting port 75 at an arbitrary angular position of every 90 degrees about the axis in the terminal inserting direction whereby the rectangular hole 83 is also oriented at the angular position of every 90 degrees about the axis.

Figure 12:
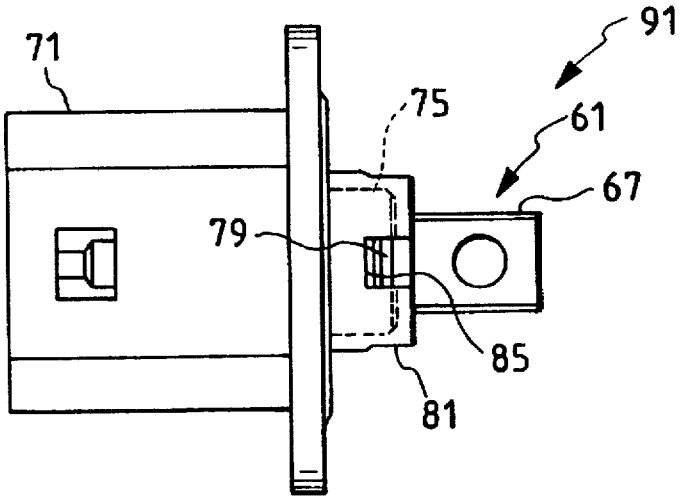
FIG. 12 is a side view of the connector of the second embodiment with the terminal vertically mounted to the connector.
Figure 13B:
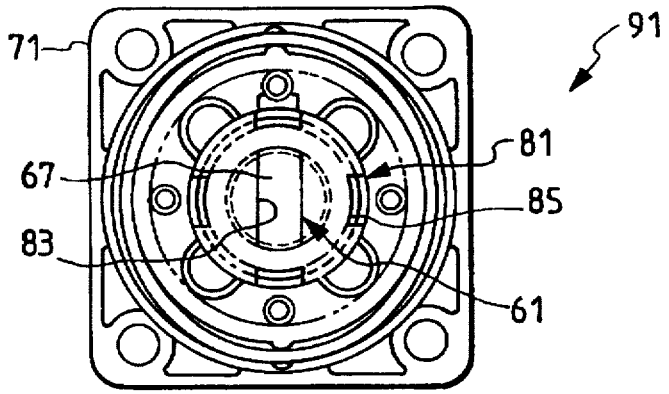
FIG. 13B is a rear view of the connector housing with the rear holder attached thereto, in which the bus bar connecting portion is vertically provided.

The functional operation of the connector 91 which comprises the terminal 61, the connector housing 71 and the rear holder 81 thus formed. FIG. 12 is a side view of the connector of this embodiment with the terminal vertically mounted to the connector. Each of FIGS. 13A and 13B is a rear view of the connector housing and the rear holder attached to the connector housing.

The terminal 61, with the body portion 63 and the bus bar connecting portion 67 which have the identical outer diameter to each other, can rotate within the terminal accommodating chamber 73. Holding the bus bar connecting portion 67 in the horizontal position is carried out by attaching the rear holder 81 to the terminal inserting port 75 so that the rectangular hole 83 is arranged in the horizontal orientation after the insertion of the bus bar connecting portion 67 into the rectangular hole 83. The engagement of the cuts 85 with the holder locking claws 79 prevents the attached rear holder 81 and the terminal 61 from rotating. Thus, the bus bar connecting portion 67 is held in the horizontal orientation as shown in FIGS. 9 and 13A. At this time, the rear end face 63*a* (FIG. 10) of the body portion 63 abuts against the end plate 81*a* of the rear holder 81 with a spacer or a rubber member (not shown) provided therebetween, and the bus bar connecting portion 67 is supported by the rectangular hole 83. Thus, the terminal 61 is locked double in addition to the locking claws 77.

On the other hand, in order to hold the bus bar connecting portion 67 in the vertical position, the rear holder 81 is disengaged from the terminal inserting port 75 to rotate the terminal 61 so that the bus bar connecting portion 67 is vertical. Then, the rear holder 81 is attached to the terminal inserting port 75 again. This prevents the rear holder 81 and the terminal 61 from rotating, similarly as described above, to hold the bus bar connecting portion 67 in the vertical orientation as shown in FIGS. 12 and 13B.

As described above, in the connector 91, the terminal 61 is held by the rear holder 81 to limit the relative rotation therebetween, and the rear holder 81 is attached to the connector housing 71 at an angular position of every 90 degrees about the axis thereof. Therefore, the bus bar connecting portion 67 is selectively held in either vertical or horizontal position. This allows the connector 91 to be adapted to the vertical and horizontal bus bars 33 (FIG. 1).

Further, when the terminal 61 is inserted at a wrong orientation, by only removing the rear holder 81 and rotating the terminal 61, the orientation of the bus bar connecting portion 67 can be easily changed between the vertical and horizontal orientations without a possible damage on the connector housing 71.

Still further, the terminal 61 is held by the rear holder 81 in addition to the locking claws 77. Thus, the terminal 61 is locked double to increase the holding force of the terminal 61 in cooperation with the locking claws 77.

Furthermore, the ribs 7 (refer to FIG. 14) are no longer required. Thus, the cost of material and machining can be greatly reduced since a material, of an outer diameter equal to that of the body portion 63, can be used instead of a material of a larger outer diameter which is required to be cut for machining the body portion 63.

As described above in detail, according to the connector for an electric vehicle of the first aspect of the invention, the bus bar connecting portion can be selectively held in either the vertical or horizontal position by making one of the slants, which are provided on the terminal to intersect perpendicularly to each other, abut against the rotation-preventing face. This allows the connector of only one type, without providing various connectors, to be adapted to the vertical and horizontal bus bars. Further, no portions projecting from the body portion of the terminal are required. Thus, the cost of material and machining can be greatly reduced since a material, of an outer diameter equal to that of the body portion, can be used instead of a material of a larger outer diameter which is required to be cut. That is, the production cost of the connector can be greatly reduced.

Further, according to the connector of the second aspect of the invention, the terminal is held by the rear holder to limit the relative rotation therebetween, and the rear holder is attached to the connector housing at an arbitrary angular position of every 90 degrees about the axis thereof. Therefore, the bus bar connecting portion can be selectively held in either vertical or horizontal position. This allows the connector of only one type to be adapted to both the vertical and horizontal bus bars. This reduces the number of variety of the connector. Further, the terminal is locked double by the rear holder in cooperation with the locking claws. Furthermore, the cost of material and machining can be also reduced since no portions projecting from the body portion of the terminal are required. That is, the production cost of the connector can be greatly reduced.

What is claimed is:

1. A connector for an electric vehicle in which a plate-like bus bar connecting portion, which is formed on a terminal, is connected in parallel to a plate-like bus bar arranged in either a vertical or horizontal orientation, said connector comprising:

a connector housing; and a terminal to be mounted into said connector housing, wherein said connector housing includes:

a terminal accommodating chamber shaped like a substantially cylindrical space; and a rotation-preventing face formed so that said rotation-preventing face is protruded radially and inwardly on an inner wall of said terminal accommodating chamber, and wherein said terminal includes:

a body portion shaped like a rod to be fitted into said terminal accommodating chamber;

a plate-like bus bar connecting portion extending from a rear end of said body portion and having a width equal to an outer diameter of said body portion; and two slants formed by cutting said body portion in a diameter direction to intersect perpendicularly to each other, one of said slants selectively abutting against said rotation-preventing face when said terminal is inserted into said terminal accommodating chamber.

2. The connector according to claim 1, wherein a peripheral groove is formed on an outer surface of said body portion of said terminal, and a flexible locking claw to be engaged with said peripheral groove is formed in said terminal accommodating chamber of said connector housing.

3. The connector according to claim 1, wherein a securing hole is formed in said bus bar connecting portion of said terminal, and said bus bar connecting portion and a bus bar are connected to each other by a bolt passing through said securing hole.

* * * * *